US005760661A

United States Patent [19]

Cohn

[11] Patent Number: 5,760,661

[45] Date of Patent: Jun. 2, 1998

[54] VARIABLE PHASE SHIFTER USING AN ARRAY OF VARACTOR DIODES FOR UNIFORM TRANSMISSION LINE LOADING

[75] Inventor: Marvin Cohn, Boca Raton, Fla.

[73] Assignee: Northrop Grumman Corporation, Los Angeles, Calif.

[21] Appl. No.: 680,303

[22] Filed: Jul. 11, 1996

[51] Int. Cl.[6] ..... H01P 1/185; H01P 9/00

[52] U.S. Cl. ..... 333/164; 333/161

[58] Field of Search ..... 333/161, 164

[56] References Cited

U.S. PATENT DOCUMENTS

| | | | |
|---|---|---|---|
| 3,803,621 | 4/1974 | Britt | 333/164 X |
| 4,604,591 | 8/1986 | Vasile | 333/161 X |
| 5,083,100 | 1/1992 | Hawkins et al. | 333/164 |
| 5,302,922 | 4/1994 | Heidemann et al. | 333/164 X |
| 5,352,994 | 10/1994 | Black et al. | 333/164 X |

OTHER PUBLICATIONS

"Microwave Diode Control Devices" by Robert V. Garver, Chapter 10, pp. 235–280, 1976 No month.

"A 94 GHz MMIC Tripler Using Anti-Parallel Diode Arrays for Idler Separation" by Marvin Cohn et al., 1994 International Microwave Symposium Digest, vol. 2, pp. 763–766 No month.

*Primary Examiner*—Robert Pascal
*Assistant Examiner*—Barbara Summons
*Attorney, Agent, or Firm*—Walter G. Sutcliff

[57] ABSTRACT

A phase shifter includes a transmission line and a plurality of varactor diodes connected in parallel to the transmission line. The varactor diodes have a high enough density that they uniformly load the transmission line. By controlling the reverse biasing of the varactor diodes, the phase shift produced by the phase shifter can be controlled.

22 Claims, 3 Drawing Sheets

FIG. 1
PRIOR ART
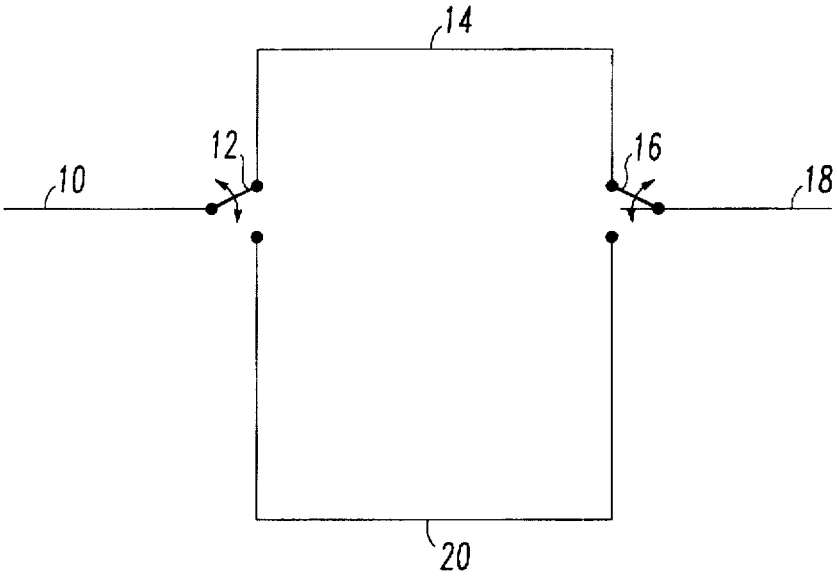
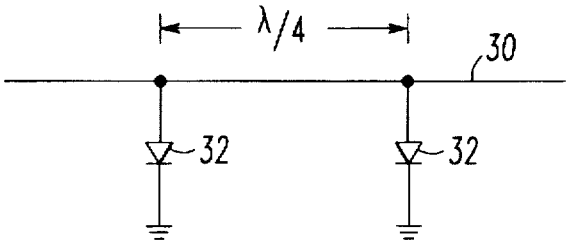
FIG. 2
PRIOR ART

FIG.5
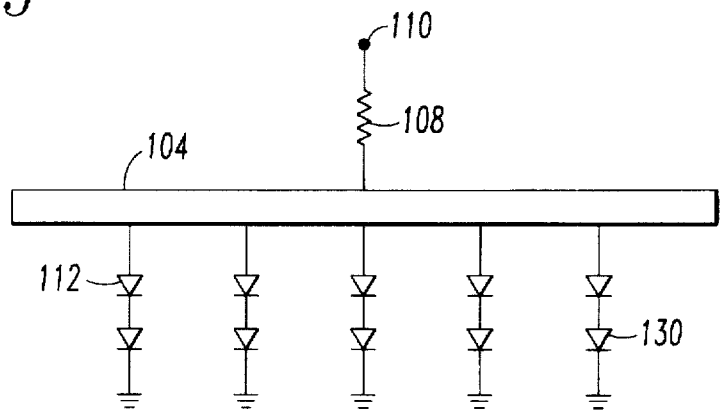
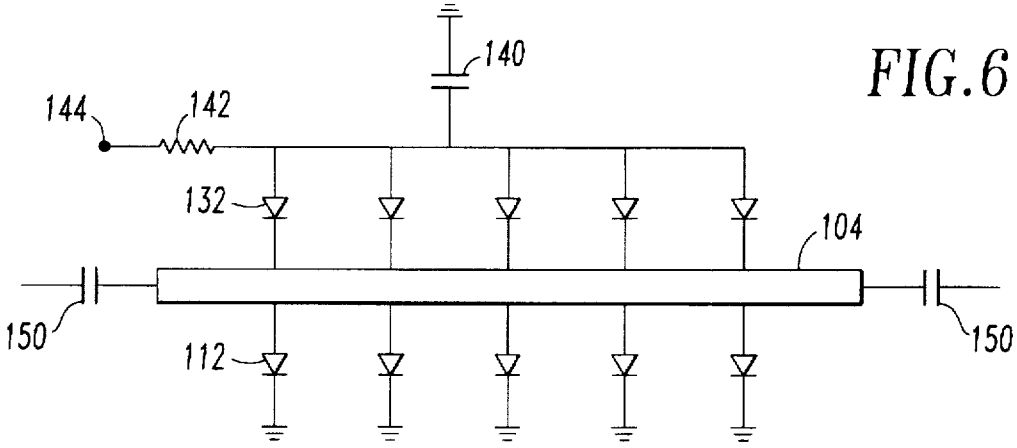
FIG.6
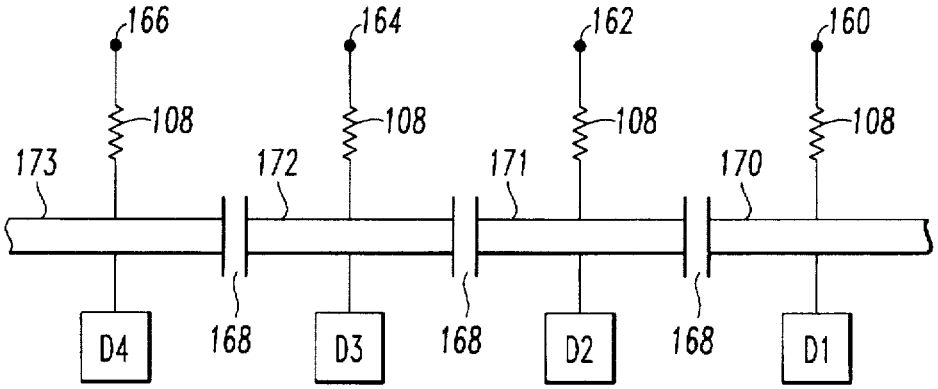
FIG.7

VARIABLE PHASE SHIFTER USING AN ARRAY OF VARACTOR DIODES FOR UNIFORM TRANSMISSION LINE LOADING

BACKGROUND OF THE INVENTION

1. Field of the Present Invention

The present invention relates to a voltage controlled, variable phase shifter; and more particularly, to a variable phase shifter using an array of varactor diodes which can operate at microwave and millimeter wave frequencies.

2. Description of the Related Art

Many types of variable phase shifters exist. FIG. 1 illustrates one of the simplest variable phase shifters. In FIG. 1, a transmission line 10 is connected by a switch 12 to either a transmission line 14 or a transmission line 20. Another switch 16, likewise connects a transmission line 18 to either the transmission line 14 or the transmission line 20. The switches 12 and 16 cooperatively operate to create a transmission path from the transmission line 10 to the transmission line 18. In FIG. 1, a waveform or signal propagating along the transmission line 10 can follow either a transmission path including the transmission line 14 or the transmission line 20. Since the transmission line 20 is longer than the transmission line 14, it will take the propagating signal a longer amount of time to propagate along the transmission path including the transmission line 20. Accordingly, the signal propagating along the signal path including the transmission line 20 will have a phase different from the signal propagating along the signal path including the transmission line 14. By controlling the switches 12 and 16, the phase of the signal output by the transmission line 18 can be shifted.

By adding additional switches and additional transmission lines of different lengths, additional transmission paths can be formed which results in a greater variety of possible phase shifts. Furthermore, many different elements may be used as the switches. For instance PIN diodes or transistors can be used as the switches. Phase shifters using such switching elements are called voltage controlled phase shifters since a control voltage determines the state of the switch.

In the case of PIN diodes, two PIN diodes are required to form a single switch. In the example of FIG. 1, the switch 12 would include (i) a first PIN diode connecting the transmission line 10 and the transmission line 14, and (ii) a second PIN diode connecting the transmission line 10 and the transmission line 20. By applying a forward bias to one of the first and second PIN diodes, current will flow through the PIN diode forming a connection between the transmission line 10 and a respective one of the transmission lines 14 and 20. As mentioned above, transistors could be used in place of the PIN diodes. In either case, however, a bias voltage is required to close the switch, and the bias voltage must be maintained to keep the switch closed. The power (voltage times current) required to maintain the bias voltage is called the holding power.

Another type of voltage controlled phase shifter is shown in FIG. 2. In this phase shifter, two varactor diodes 32 are connected to a transmission line 30 a quarter-wavelength ($\lambda/4$, where $\lambda$ represents the wavelength of the signal propagating across the transmission line 30). A varactor diode, when reverse biased, has a capacitance which varies based on the bias. The varactor diodes 32 delay the propagation of the signal across the transmission line 30 as a function of their capacitance by changing the propagation constant of the transmission line. Consequently, by changing the bias voltage, the propagation delay (i.e., phase shift) of the propagating signal on transmission line 30 can be changed. Since the varactor diodes 32, however, are reversed biased, virtually no current flows across the varactor diodes 32. Therefore, the holding power for a given phase shift is virtually nil.

Conventional loaded line phase shifters using varactor diodes connect the varactor diodes to a transmission line at intervals of a quarter-wavelength as illustrated in FIG. 2 ("Microwave Diode Control Devices," by Robert V. Garver, Chapter 10, pages 235–280, 1976; and "Microwave Semiconductor Devices And Their Circuit Applications," by H. A. Watson, page 338, 1969). As taught by Garver, separating the varactor diodes by a quarter-wavelength provides partial cancellation of their mismatches (see page 235). Microwave Associates, Inc. produced such a phase shifter operating in the vicinity of 3 GHz with a 12 percent bandwidth, and having an input VSWR (voltage standing wave ratio) of less than 1.15 for any phase state.

In certain systems, such as microwave and millimeter wave electronically scanned arrays (ESAs) (both passive arrays and active aperture systems) the need arises for variable phase shifters which phase shift microwave or millimeter wave signals. Desirable properties for such phase shifters are: low insertion loss, low incidental amplitude modulation, low power drain (i.e., little or no holding power at any phase state), fast switching, monolithic implementation for small size and low cost, and moderate and high power handling capability.

In the case of passive ESAs (not active aperture systems), low insertion loss is particularly important because there is no amplification on the antenna side of the phase shifter. As a result, phase shifter losses directly reduce the power output during transmission and add to the system noise figure during reception. The phase shifters in these systems must also handle the full power to be delivered to each radiating element of the array.

At millimeter wavelengths, the insertion loss of presently available monolithic microwave integrated circuit (MMIC) phase shifters is very high; for example, 9 to 10 dB for a 4 bit 35 GHz phase shifter using pseudomorphic high electron mobility transistors (PHEMT) as switching elements. At 94 GHz, it is expected that a similar phase shifter would have an insertion loss of 15 to 17 dB. At these frequencies, many power consuming amplification stages are required to compensate for the phase shifter losses.

SUMMARY OF THE INVENTION

One object of the present invention is to provide a phase shifter having low insertion loss.

A further object of the present invention is to provide a phase shifter having low power drain.

An additionally object of the present invention is to provide a phase shifter capable of quickly switching between phase shifts.

Another object of the present invention is to provide a monolithically implemented phase shifter.

Also an object of the present invention is the provision of a phase shifter which has moderate and high power handling capabilities.

Another object of the present invention is to provide a phase shifter having low incidental amplitude modulation.

A further object of the invention is to provide a digital phase shifter.

These and other objectives can be achieved by providing a phase shifter, comprising: a transmission line for carrying a signal; a plurality of varactor diodes connected in parallel to said transmission line and uniformly loading said transmission line; and bias means for applying a reverse bias to said plurality of varactor diodes.

These and other related objects can further be achieved by providing a phase shifter, comprising: a transmission line for carrying a signal having a wavelength; a plurality of varactor diodes connected in parallel to said transmission line such that at least thirty-six diodes per said wavelength are connected to said transmission line; and bias means for applying a reverse bias to said plurality of varactor diodes.

These and other related objects are also achieved by providing a phase shifter, comprising: a transmission line for carrying a signal having a wavelength; a plurality of varactor diodes connected in parallel to said transmission line, a distance separating at least two of said plurality of varactor diodes along said transmission line being said wavelength/35 or less; and bias means for applying a reverse bias to said plurality of varactor diodes.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

FIG. 1 illustrates a conventional phase shifter;

FIG. 2 illustrates a conventional voltage controlled phase shifter using varactor diodes;

FIG. 5 illustrates the circuit diagram of another embodiment of a phase shifter using varactor diodes according to the present invention;

FIG. 6 illustrates the circuit diagram of another embodiment of a phase shifter using varactor diodes according to the present invention; and FIG. 7 illustrates the circuit diagram of a digital embodiment of a phase shifter using varactor diodes according to the present invention.

DETAILED DESCRIPTION OF THE PREFERRED EMBODIMENTS

Figure 3:
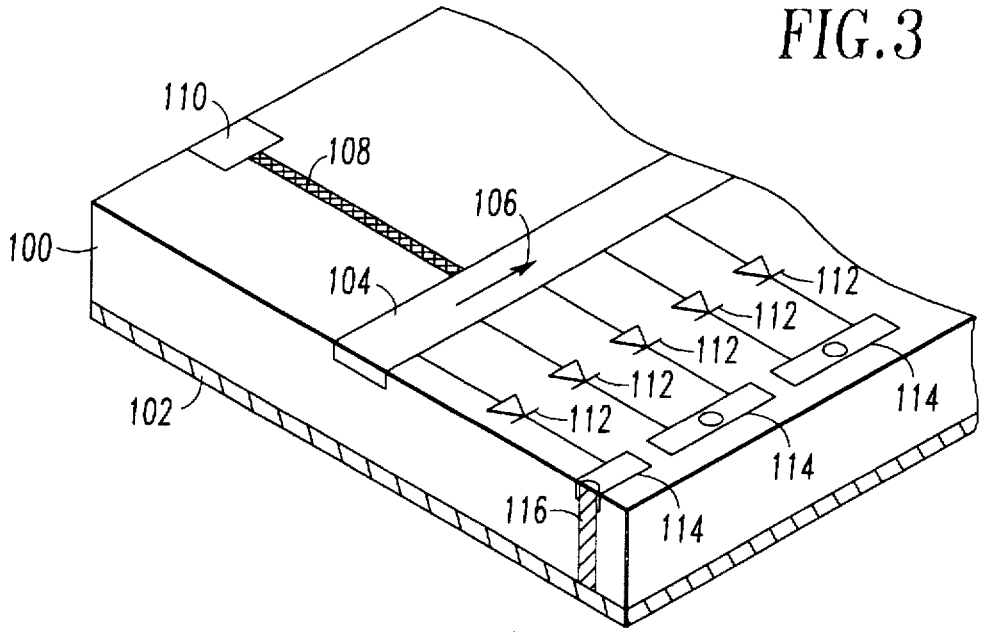
FIG. 3 illustrates a voltage controlled phase shifter using varactor diodes according to the present invention.

FIG. 3 illustrates a monolithically implemented voltage controlled phase shifter using varactor diodes according to the present invention. Using any well known process, such as a thin-film metalization process, a microstrip transmission line 104 is formed on a substrate 100. The substrate 100 is formed of any semiconductor material. In a preferred embodiment, GaAs was chosen as the substrate 100.

A high density of varactor diodes 112 per wavelength of the waveform or signal to propagate along the transmission line 104 as illustrated by the arrow 106 are then formed on the substrate 100. The formation of a high density of varactor diodes per wavelength using monolithic technology was described in "A 94 GHz MMIC Tripler Using Anti-Parallel Diode Arrays for Idler Separation," by M. Cohn, H. G. Henry, J. E. Degenford and D. A. Blackwell, 1994 International Microwave Symposium Digest, Volume 2, pages 763–766, and presented at the 1994 IEEE MTT-S International Microwave Symposium in San Diego, Calif.; May 23–27, 1994. Accordingly, applicants hereby incorporate the Cohn et al. article by reference.

The varactor diodes 112 are formed connected in parallel to the transmission line 104. In a preferred embodiment, the varactor diodes 112 are Schottky barrier varactor diodes. The anodes of the varactor diodes 112 connect to the transmission line 104, and the cathodes of the varactor diodes 112 connect to a corresponding metal pad 114. The pads 114 may be formed of any metal such as gold. In the embodiment illustrated in FIG. 3, two of the varactor diodes 112 are connected to each of the pads 114, however, the present invention is not limited to this arrangement. Each of the pads 114 has a via 116 connecting the pad 114 to a ground plane 102. The phase shifter of FIG. 3 further includes a bias contact pad 110 connected to the transmission line 104 via a thin film resistor 108. The techniques for forming (i) metal pads having vias to ground, (ii) a thin film resistor, and (iii) bias contact pads are well known; and therefore, will not be described.

By forming a high density of the varactor diodes 112 along the transmission line 104 as discussed above, the signal propagating along the transmission line 104 sees a uniformly loaded transmission line. Additionally, as the number of varactor diodes per wavelength increases, the capacitance of each varactor diode 112 necessary for causing a desired phase shift decreases. Accordingly, a sufficient number of varactor diodes 112 per wavelength renders impedance mismatches negligible. By contrast, the prior art technique (FIG. 2) used the varactor diodes 32 separated by a quarter-wavelength apart. Since so few varactor diodes 32 are used, the varactor diodes 32 must present a high capacitance to obtain a desired phase shift. This high capacitance presents the problem of impedance mismatches. Accordingly, the prior art technique teaches placing the varactor diodes 32 a quarter-wavelength apart to cancel the impedance mismatches.

The following perturbation analysis represents the performance of the phase shifter according to the present invention. The phase ($\phi$) can be determined according to the following equation:

$$\phi = B1 = w(LC)^{1/2} \cdot 1 \quad (1)$$

where B represents the propagation constant of the transmission line 104, 1 represents the length of the transmission line 104, w represents the radian frequency of the signal incident to the transmission line 104, L represents the inductance per unit length of the transmission line 104, and C represents the capacitance per unit length of the transmission line 104.

The transmission line 104 initially has a characteristic impedance given by the following equation:

$$Z_o = (L/C)^{1/2} \quad (2)$$

where $Z_o$ represents the characteristic impedance of the transmission line 104.

When the transmission line 104 is loaded by the closely spaced varactor diodes 112, the characteristic impedance of the transmission line 104 lowers as indicated in the following equation:

$$Z_o = \left( \frac{L}{C + Cd(v)} \right)^{1/2} \quad (3)$$

wherein $C_d(v)$ represent the capacitance per unit length added by the varactor diodes 112 and v is the reverse bias voltage.

Accordingly, differentiating equation (1) with respect to capacitance results in the following equation:

$$\Delta\phi = \frac{d\phi}{dc}\,\Delta C = \frac{wl}{2}\left(\frac{L}{C}\right)^{1/2}\Delta C = \frac{wlZ_o}{2}\,\Delta C \tag{4}$$

which demonstrates that changing the capacitance of the varactor diodes 112, changes the phase shift produced by the phase shifter of the present invention. Therefore, by controlling the capacitance of the varactor diodes 112, the phase shift can be controlled.

As discussed above, for the perturbation analysis to apply, the varactor diodes 112 must be closely spaced. The observable signs of the perturbation analysis breaking down are the VSWR going up and/or VSWR ripples in the frequency band of operation. The minimum number of varactor diodes 112 is, therefore, dependent on the VSWR that can be tolerated. Preferably, at least 36 varactor diodes 112 per wavelength λ (i.e. a varactor diode 112 every 10 degrees) provides a sufficiently low VSWR. Therefore, a preferred spacing between the varactor diodes 112 is λ/35 or less.

The amount of reverse bias applied to the varactor diodes 112 controls the capacitance thereof. In the embodiment of FIG. 3, a DC bias is applied to the transmission line 104 to reverse bias the varactor diodes 112. A DC voltage applied to the bias contact pad 110 is supplied to the transmission line 104 via the resistor 108. The resistor 108 has a resistance much greater than the resistance of the transmission line 104 to prevent signal current along the transmission line 104 from leaking into the resistor 108. Therefore, controlling the bias applied to the bias contact pad 110 controls the capacitance of the varactor diodes 112 and the phase shift produced by the phase shifter.

If the diode loaded transmission line's attenuation ($\alpha_d$) is due only to the varactor diode's finite cut-off frequency ($f_{co}$) resulting from the varactor diode's series resistance, Rs, and voltage dependent capacitance, $C_d(V)$, then $$\alpha_d = \frac{\beta\omega C_d(V)R_s}{2} = \frac{\beta}{2}\cdot\frac{f}{f_{co}} \tag{5}$$

The figure of merit, M=Δφ/IL, where the insertion loss, IL=$\alpha_d$ 1 is $$M = \frac{\Delta\phi}{IL} = \frac{\Delta\beta l}{\alpha_d l} = \frac{\Delta\beta}{\alpha_d} \tag{6}$$

From (5) and (6), $$M = \frac{\Delta C}{C}\cdot\frac{f_{co}}{f} \tag{7}$$

Based on the above idealization that ignores the transmission line losses other than those due to the diodes loading the line, the following performance was calculated for a 10 GHz phase shifter that provides 360° of phase shift.

| | |
|---|---|
| Diode Anode Dimensions | 1.5 μm × 30 μm |
| Diode Cut-off Frequency | ≅800 GHz |
| Diode Spacing (S) | 0.2 mm (50 diodes/cm.) |
| Average $Z_o$ | 45.1 Ω |
| Min $Z_o$ for $C_d$(V = 0 volts) | 40.8 Ω |
| Max $Z^1_o$ for $C_d$(V = .5 volts) | 51.0 Ω |
| Δφ/1 | 105.5 degrees/cm |
| 1 for Δφ = 360° | 3.4 cm |
| $\alpha_d$ | 0.3 dB/cm |
| IL = $\alpha_d$1 | 1.02 dB |
| M = ΔφIL | 351°/db |

Adding the attenuation ($\alpha_L$=0.158 dB/cm.) due to dielectric and conductor losses of a 50 ohm microstrip line on 0.010" thick GaAs the total insertion loss increases to 1.57 dB and the figure of merit decreases to 230°/dB.

The above plus similar calculations for phase shifters operating at 31.3 GHz and 94 GHz are tabulated below.

| Frequency (GHz) | 10 | 31.3 | 94 |
|---|---|---|---|
| Diode Anode Dimensions (μm) | 1.5 × 30 | 1.5 × 10 | 0.5 × 10 |
| Diode Spacing, S (cm.) | 0.02 | 0.0067 | 0.0022 |
| Phase Shift per Unit Length, Δφ/1 (°/cm) | 105.5 | 342 | 1025 |
| 1 for Δφ = 360° (cm) | 3.4 | 1.05 | 0.353 |
| Attenuation Due to Diode Losses, $\alpha_d$ (db/cm) | 0.3 | 2.95 | 21.2 |
| Attenuation Due to Transmission Line Losses, $\alpha_L$(db/cm) | 0.158 | 0.71 | 1.23 |
| Insertion Loss, IL = ($\alpha_d$ + $\alpha_L$)1 (dB) | 1.57 | 3.8 | 7.88 |
| Figure of Merit, M = Δφ/IL (°/dB) | 230 | 95 | 45.7 |

The change in shunt capacitance due to the voltage variable capacitance of the varactor diodes 112 also causes the characteristic impedance ($Z_o$) to vary, which in turn results in some undesirable incidental amplitude modulation. In the calculations made for the three cases shown in the preceding table, the characteristic impedance $Z_o$ varied less than ±12% from the average value, which would produce negligible incidental AM.

Figure 4:
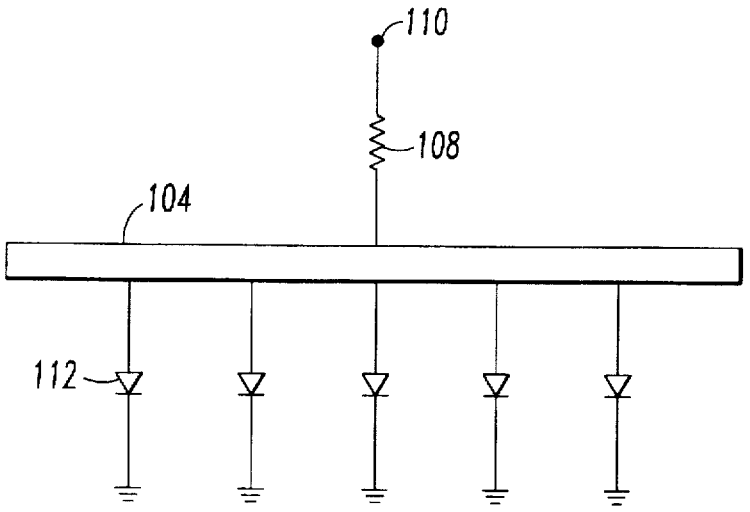
FIG. 4 is a circuit diagram of the phase shifter illustrated in FIG. 3.

The method of reverse biasing the varactor diodes 112 is not limited to the method shown in FIGS. 3 and 4. For instance, a first potential can be supplied to the transmission line 104, including a zero or even a negative potential. Then, a second potential less than the first potential can be applied to the pads 114; the difference between the first and second potential being sufficient to reverse bias the varactor diodes 112.

FIG. 5 illustrates another embodiment of the present invention. FIG. 5 differs from the embodiment of FIGS. 3–4 in that a varactor diode 130 has been added in series with each of the varactor diodes 112. The varactor diodes 130 are the same as the varactor diodes 112; and preferably are Schottky barrier diodes. Adding additional varactor diodes 130 in series with the varactor diodes 112 increases the power handling capabilities of the phase shifter by increasing its breakdown voltage. For n diodes in series, the breakdown voltage is increased by a factor of n over that of a single diode. Accordingly, more than one varactor diode can be added in series with each of the varactor diodes 112 depending on the desired power handling capability and the desired breakdown voltage.

FIG. 6 illustrates another embodiment for increasing the power handling capabilities of the phase shifter. The embodiment of FIG. 6 differs from the embodiment of FIGS. 3–4 in (i) that a second plurality of varactor diodes 132 have been connected in parallel to the transmission line 104 and (ii) the manner in which a reverse bias is applied to the varactor diodes 112 and the varactor diodes 132. Each of the second plurality of varactor diodes 132 are connected to the transmission line 104 at the same position as one of the varactor diodes 112. As shown in FIG. 6, the varactor diodes 132 have their cathodes connected to the transmission line 104. The anodes of the varactor diodes 132 are connected to ground via a capacitor 140 and to a bias contact pad 144 via a resistor 142. The capacitor 140 appears as an open circuit to a DC potential applied to the bias contact pad 144. Furthermore, a blocking capacitor 150 has been connected to either end of the transmission line 104.

The blocking capacitors 150 cause the transmission line 104 to have a floating DC potential. Thus, when a reverse bias is applied to the varactor diodes 132 via the bias contact pad 144 and the resistor 142, the transmission line 104 attains a DC voltage which reverse biases the varactor diodes 112. Preferably, the varactor diodes 132 are the same as the varactor diodes 112 so that the same amount of reverse bias will be applied to both the varactor diodes 132 and 112. In a preferred embodiment, the varactor diodes 112 and 132 are Schottky barrier varactor diodes. Additionally, to produce a phase shifter having the same phase shift characteristics as the embodiment of FIGS. 3–4, the varactor diodes 132 and 112 in FIG. 6 will have to be half the size as the varactor diodes 112 in FIGS. 3–4.

The signal propagating along the transmission line 104 can affect the characteristics of the varactor diodes 112; namely the capacitance thereof. Consequently, the signal propagating along the transmission line 104 induces a certain amount of phase shift. The greater the power of the signal, the greater the induced phase shift.

Adding the varactor diodes 132 serves to cancel the phase shift induced by the propagating signal with respect to the varactor diodes 112. Due to the arrangement of the varactor diodes 132, the signal propagating along the transmission line 104 affects the varactor diodes 132 in an opposite manner compared to the effect on the varactor diodes 112. Accordingly, the phase shift induced by the propagating signal with respect to the varactor diodes 132 cancels the phase shift induced by the propagating signal with respect to the varactor diodes 112. In this manner, the addition of the varactor diodes 132 increases the power handling capabilities of the phase shifter.

As one skilled in the art will readily recognize, the power handling capability of the phase shifter according to the present invention can be further increased by combining the features of the embodiments illustrated in FIGS. 5 and 6.

The embodiments of the phase shifters discussed above are analog phase shifters or continuous phase shifters. These phase shifters can be converted into digital phase shifters by digital-to-analog converting a digital phase shift signal and supplying the converted signal to the above discussed phase shifters. Alternatively, the techniques discussed above can be used to produce a digital phase shifter.

FIG. 7 illustrates one embodiment of a digital phase shifter according to the present invention. A plurality of transmission line segments 170–173 are connected in series via coupling capacitors 168. The coupling capacitors 168 have a low impedance compared to the transmission line segments 170–173. Accordingly, the propagating signal propagates along the transmission line segments 170–173 as a single transmission line. The coupling capacitors 168, however, appear as open circuits to any DC bias applied to the transmission line segments 170–173. This allows each of the transmission line segments 170–173 to be independently biased.

Each transmission line segment 170–173 has a DC bias applied thereto via the resistors 108 and the bias contact pads 160–166, respectively. Each of the bias contact pads 160–166 receives a bit of a digital signal. Accordingly, in the embodiment of FIG. 7, the phase shifter receives a 4-bit digital signal instructing the phase shift.

A plurality of arrays of varactor diodes D1–D4 are connected to each of the transmission line segments 170–173, respectively. The arrays of varactor diodes D1–D4 satisfy the constraints discussed above with respect to the embodiment of FIGS. 3–4 to achieve uniformly loaded transmission line segments.

In one embodiment, the number of varactor diodes in each diode array D1–D4 differ from each other such that applying a fixed bias to each one of the bias contact pads 160–166 causes a fixed phase shift. For instance, the number of varactor diodes in the diode array D1 can be set to achieve a 180 degree phase shift for a given DC voltage, the number of diodes in the diode array D2 can be set to achieve a 90 degree phase shift for the given DC voltage, the number of varactor diodes in the diode array D3 can be set to achieve a 45 degree phase shift for the given DC voltage, and the number of varactor diodes in the diode array D4 can be set to achieve a 22.5 degree phase shift for the given DC voltage. It should be understood that any number of transmission line segments producing any predetermined phase shifts for a fixed voltage can be produced.

In another embodiment, the number of varactor diodes in each diode array D1–D4 is set the same, and the length of the transmission line segments 170–173 differ to produce different phase shifts in response to a fixed bias voltage. Alternatively, a combination of differing the number of varactor diodes per transmission line segment and differing the length of the transmission line segments can be used to obtain discrete phase shifts per transmission line segment. The embodiment of FIG. 7 can also be modified as discussed above with respect to FIGS. 5 and/or 6 to improve the power handling capabilities of the digital phase shifter.

The embodiments discussed above with respect to FIG. 7 can also serve as analog phase shifters. Instead of applying a fixed bias to the bias contact pads 160–166, an analog embodiment would apply variable biases to each of the bias contact pads 160–166. Consequently, in the analog embodiment, each transmission line segment produces a corresponding phase shift range as opposed to a discrete phase shift in the digital embodiments.

As a further alternative, digital and analog embodiments can be combined into a single embodiment.

While the invention has been described in connection with what is presently considered the most practical and preferred embodiments, it is to be understood that the invention is not limited to the disclosed embodiments, but on the contrary, is intended to cover various modifications and equivalent arrangements included within the spirit and scope of the appended claims.

What is claimed:

1. A phase shifter comprising:

a transmission line for carrying a signal;

a plurality of varactor diodes connected in parallel to said transmission line and being limited but sufficient in number per wavelength of the signal to load said transmission line substantially uniformly and to eliminate any need for line termination impedance matching; and bias means for applying a reverse bias to said plurality of varactor diodes.

2. The phase shifter of claim 1, wherein said bias means controls a phase shift produced by said phase shifter by varying said reverse bias.

3. The phase shifter of claim 1, wherein said bias means applies a variable direct current voltage to said transmission line.

4. The phase shifter of claim 3, wherein said plurality of varactor diodes are connected to said transmission line and a reference voltage.

5. The phase shifter of claim 1, wherein said plurality of varactor diodes are connected between said transmission line and a reference voltage.

6. The phase shifter of claim 1, wherein said plurality of varactor diodes are connected between said transmission line and said bias means, and said transmission line is connected to a reference direct current voltage.

7. The phase shifter of claim 1, wherein said bias means independently supplies said bias to each of said plurality of varactor diodes.

8. The phase shifter of claim 1, wherein said transmission line includes at least first and second transmission line segments connected via a capacitor;

a first number of said plurality of varactor diodes are connected to said first transmission line segment, and a second number of said plurality of varactor diodes are connected to said second transmission line segment; and said bias means independently biases said first number of said plurality of varactor diodes and said second number of said plurality of varactor diodes.

9. The phase shifter of claim 8, wherein said bias means independently applies a bias to said first number of said plurality of varactor diodes and said second number of said plurality of varactor diodes in response to a digital signal.

10. The phase shifter of claim 9, wherein each bit of said digital signal corresponds to one of said first number of said plurality of varactor diodes and said second number of said plurality of varactor diodes, and a state of each bit instructs said bias means on said bias to apply to a corresponding one of said first number of said plurality of varactor diodes and said second number of said plurality of varactor diodes.

11. The phase shifter of claim 9, wherein said first number of said plurality of varactor diodes differs from said second number of said plurality of varactor diodes such that said bias means effects a first predetermined phase shift by applying a bias to said first number of said plurality of varactor diodes and effects a second predetermined phase shift by applying a bias to said second number of said plurality of varactor diodes, said first predetermined phase shift being different from said second predetermined phase shift.

12. The phase shifter of claim 9, wherein said first transmission line segment has a length different from a length of said second transmission line segment such that said bias means effects a first predetermined phase shift by applying a bias to said first number of said plurality of varactor diodes and effects a second predetermined phase shift by applying a bias to said second number of said plurality of varactor diodes, said first predetermined phase shift being different from said second predetermined phase shift.

13. The phase shifter of claim 9, wherein said first number of said plurality of varactor diodes differs from said second number of said plurality of varactor diodes and said first transmission line segment has a length different from a length of said second transmission line segment such that said bias means effects a first predetermined phase shift by applying a bias to said first number of said plurality of varactor diodes and effects a second predetermined phase shift by applying a bias to said second number of said plurality of varactor diodes, said first predetermined phase shift being different from said second predetermined phase shift.

14. The phase shifter of claim 8, wherein said first number of said plurality of varactor diodes differs from said second number of said plurality of varactor diodes such that said bias means effects a first range of phase shifting by applying a variable bias to said first number of said plurality of varactor diodes and effects a second range of phase shifting by applying a variable bias to said second number of said plurality of varactor diodes, said first range of phase shifting being different from said second range of phase shifting.

15. The phase shifter of claim 8, wherein said first transmission line segment has a length different from a length of said second transmission line segment such that said bias means effects a first predetermined phase shift by applying a variable bias to said first number of said plurality of varactor diodes and effects a second range of phase shifting by applying a variable bias to said second number of said plurality of varactor diodes, said first range of phase shifting being different from said second range of phase shifting.

16. The phase shifter of claim 8, wherein said first number of said plurality of varactor diodes differs from said second number of said plurality of varactor diodes and said first transmission line segment has a length different from a length of said second transmission line segment such that said bias means effects a first predetermined phase shift by applying a variable bias to said first number of said plurality of varactor diodes and effects a second range of phase shifting by applying a variable bias to said second number of said plurality of varactor diodes, said first range of phase shifting being different from said second range of phase shifting.

17. The phase shifter of claim 1, wherein said phase shifter is monolithically implemented.

18. The phase shifter of claim 1, wherein said plurality of varactor diodes are Schottky barrier diodes.

19. The phase shifter of claim 1, further comprising:

at least one varactor diode connected in series to each of said plurality of varactor diodes.

20. The phase shifter of claim 1, wherein said plurality of varactor diodes includes a first plurality of varactor diode circuit paths connected in parallel along said transmission line, and a second plurality of varactor diode circuit paths connected in parallel along said transmission line and in alignment with said first plurality of varactor diode circuit paths, said first plurality of varactor diode circuit paths having one of a varactor diode anode and a varactor diode cathode connected to said transmission line, and each of said second plurality of varactor diode circuit paths having an other one of a varactor diode anode and a varactor diode cathode connected to said transmission line.

21. A phase shifter, comprising:

a transmission line for carrying a signal having a wavelength;

a plurality of varactor diodes connected in parallel to said transmission line such that at least thirty-six diodes per said wavelength are connected to said transmission line to substantially uniformly load the line and eliminate any need for line termination impedance matching; and bias means for applying a reverse bias to said plurality of varactor diodes.

22. A phase shifter comprising:

a transmission line for carrying a signal having a wavelength;

a plurality of varactor diodes connected in parallel to said transmission line in sufficient number per wavelength of the signal to load said transmission line substantially uniformly and to eliminate any need for line termination impedance matching, a distance separating at least two of said plurality of varactor diodes along said transmission line being said wavelength divided by 35, or less; and bias means for applying a reverse bias to said plurality of varactor diodes.

* * * * *